US005452703A

United States Patent [19]

Bateman, III

[11] Patent Number: 5,452,703

[45] Date of Patent: Sep. 26, 1995

[54] ARROW HOLDER FOR DIFFERENT SIZED ARROWS

[76] Inventor: Earle W. Bateman, III, P.O. Box 751, Fischer, Tex. 78623

[21] Appl. No.: 222,756

[22] Filed: Apr. 4, 1994

[51] Int. Cl.[6] ..... F41B 5/06

[52] U.S. Cl. ..... 124/86; 124/25.7; 124/41.1

[58] Field of Search ..... 124/23.1, 24.1, 124/25.5, 25.7, 41.1, 44.5, 86, 88; 403/220, 221, 225, 315, 319

[56] References Cited

U.S. PATENT DOCUMENTS

| | | | |
|---|---|---|---|
| 3,561,651 | 2/1971 | Ramsey | 124/25.7 X |
| 3,591,062 | 7/1971 | Karbo | 124/25.7 X |
| 3,595,214 | 7/1971 | O'Malley | 124/25.7 |
| 3,716,174 | 2/1973 | Ehlert | 124/25.7 X |
| 4,073,328 | 2/1978 | Franklin | 124/25.7 X |
| 4,156,496 | 5/1979 | Stinson | 124/25.7 |
| 5,190,022 | 3/1993 | Larson | 124/25.7 |
| 5,215,070 | 6/1993 | Brown | 124/25.7 X |

*Primary Examiner*—John A. Ricci
*Attorney, Agent, or Firm*—Fulbright & Jaworski

[57] ABSTRACT

An arrow holder for use in a quiver for holding arrows having different sized shafts. A flexible mount is supported in a rigid bracket. The mount includes an entrance and at least one arrow shaft storage space for receiving a shaft. A pair of opposing arrow shaft restrictors are positioned between the storage space and the entrance and a capacity insert slot is positioned adjacent the storage space for receiving an insert for changing the size of the storage space. The storage space may also be changed in size by a mount positioning means pressing against the mount for changing the position of the mount.

11 Claims, 6 Drawing Sheets

ARROW HOLDER FOR DIFFERENT SIZED ARROWS

BACKGROUND OF THE INVENTION

The present invention is directed to an arrow holder for use in a quiver for holding arrows having different sized shafts.

There are many types of arrow holders used on bow or side-mounted hunting quivers. With the modern bows in use today, one of the biggest changes has been in the arrow design. A desire for more arrow speed has lead to aluminum arrows having a thin wall but with arrow shaft diameters as large as 25/64 inch. On the other hand, the producers of small sized carbon or graphite arrows make shafts under 5/32 inch in diameter. There are rubber arrow holder designs available that allow for limited use of different sized arrows, but not an inexpensive one that fits all sizes. Most use an expandable arrow space that expands sideways or outwards. Therefore, most manufacturers solve the problem of having a variety of arrow sizes by having different sized holders for different sized arrows.

The present invention is to provide an inexpensive arrow holder that can be used with all popular arrows including larger aluminum arrows and small size arrows. For example only, the present arrow holder allows the use of arrow sizes ranging from under 5/32 inch up to 25/64 inch in diameter. The present arrow holder provides a good secure fit for all sizes, reduces the chance of losing arrows, is easy to use, safe, quiet, and provides adequate arrow spacing between arrows.

SUMMARY

The present invention is directed to an arrow holder for use with a quiver for holding arrows having different sizes of shafts and in which the size range of arrows that can be used can be accommodated by varying the size of the arrow shaft storage space.

Still a further object of the present invention is the provision of an arrow holder having a flexible mount for receiving different sized shafts of arrows in which the mount has a top, bottom, front and back. A rigid bracket engages and supports the top and bottom of the flexible mount. The mount has an entrance at the front with a flexible tip positioned at the side of the entrance and the mount includes at least one arrow shaft storage space connected to the entrance for receiving a shaft. A pair of opposing arrow shafts restrictors are positioned between the storage space and the entrance, and a capacity insert slot is positioned in the mount adjacent the storage space for receiving an insert for changing the size of the storage space.

Still a further object of the present invention is the provision of an insert for insertion into the capacity insert slot in which the insert is curved for adjusting the size of the storage space.

Still a further object is the provision of mount positioning means for connecting between the bracket and the back of the flexible mount for changing the position of the back and the capacity of the storage space. In one embodiment, the mount positioning means is a screw and another embodiment the mount positioning means is a multi-position insert, and in still a further embodiment the mount positioning means is a slip insert.

Yet a further object is wherein the flexible mount includes oval holes extending between the front and back of the mount for receiving fasteners for allowing front to back movement of the mount relative to the bracket.

A still further object is the provision of a pair of contact points on the back of the flexible mount positioned for engagement by the mount positioning means.

Still a further object is the provision of an arrow holder including a flexible mount for receiving different sized shafts of arrows, a rigid U-shaped bracket engaging and supporting the top and bottom of the flexible mount. The mount includes an entrance at the front of the mount with a flexible tip positioned on each side of the entrance and the mount includes first and second variable sized arrow storage spaces each of which spaces are connected to the entrance for receiving a shaft. A pair of opposing shaft restrictors are positioned between each storage space and the entrance. A capacity insert slot is positioned in the mount adjacent each storage space for receiving an insert for changing the size of the adjacent storage space.

A further object of the present invention is the provision of a diverter peak positioned in the entrance midway between the first and second shaft storage spaces.

Yet a further object is the provision of a compression slot positioned adjacent the diverter peak.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENT

Figure 6:
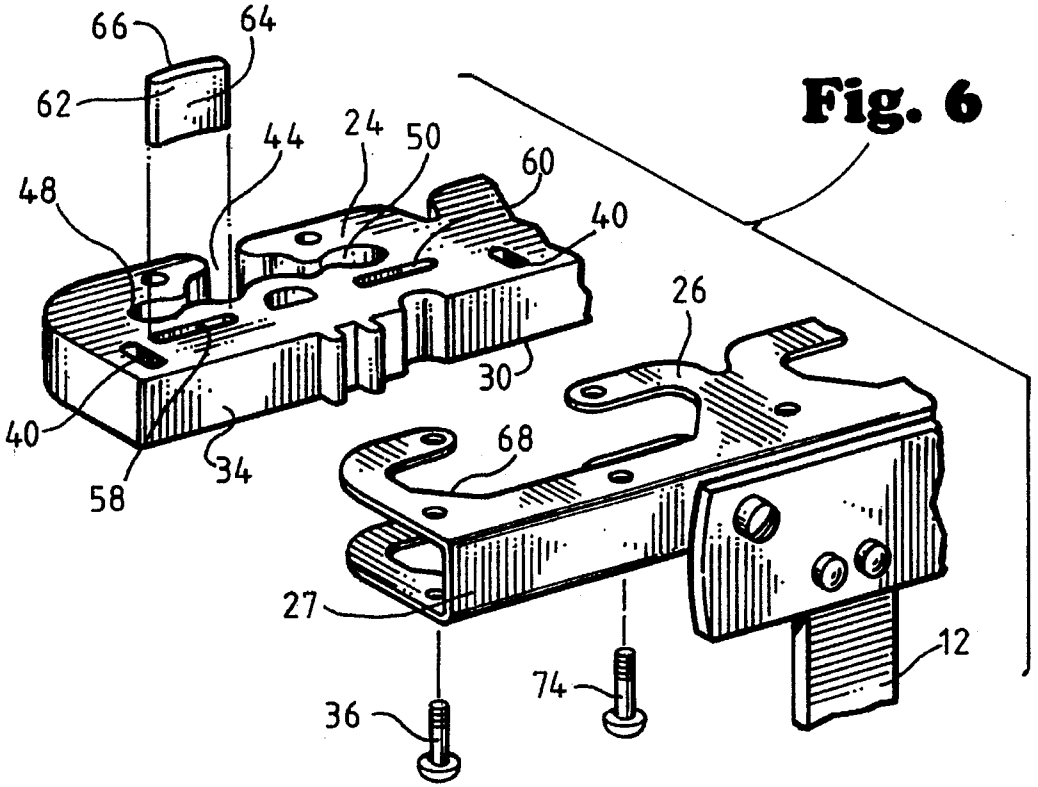
FIG. 6 is a fragmentary exploded perspective view illustrating ways of assembling and varying the size range of arrows that can be handled.
Figure 5:
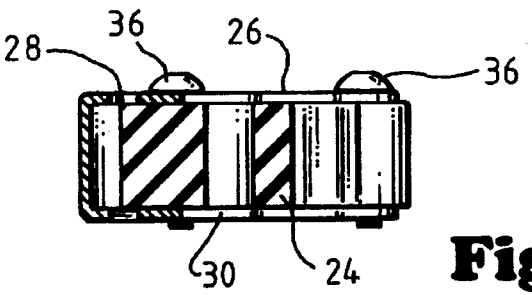
FIG. 5 is a cross-sectional view taken along the line 5—5 of FIG. 3.
Figure 1:
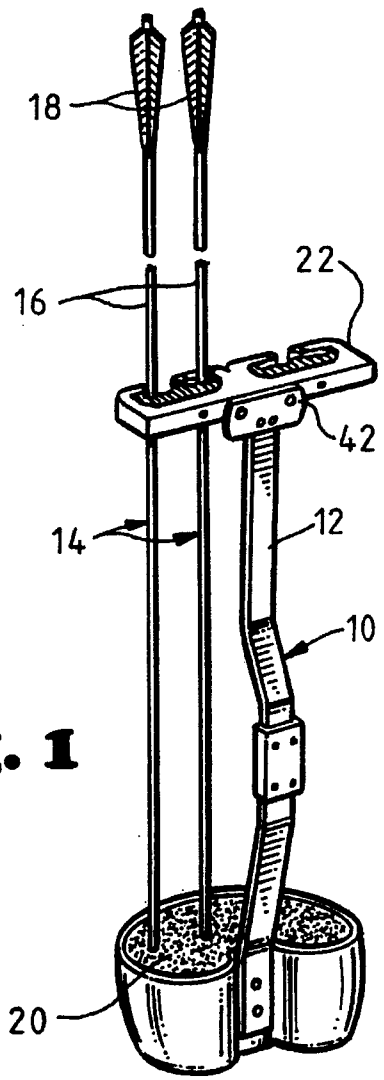
FIG. 1 is an elevational, perspective view of the present invention in use with a quiver.
Figure 2:
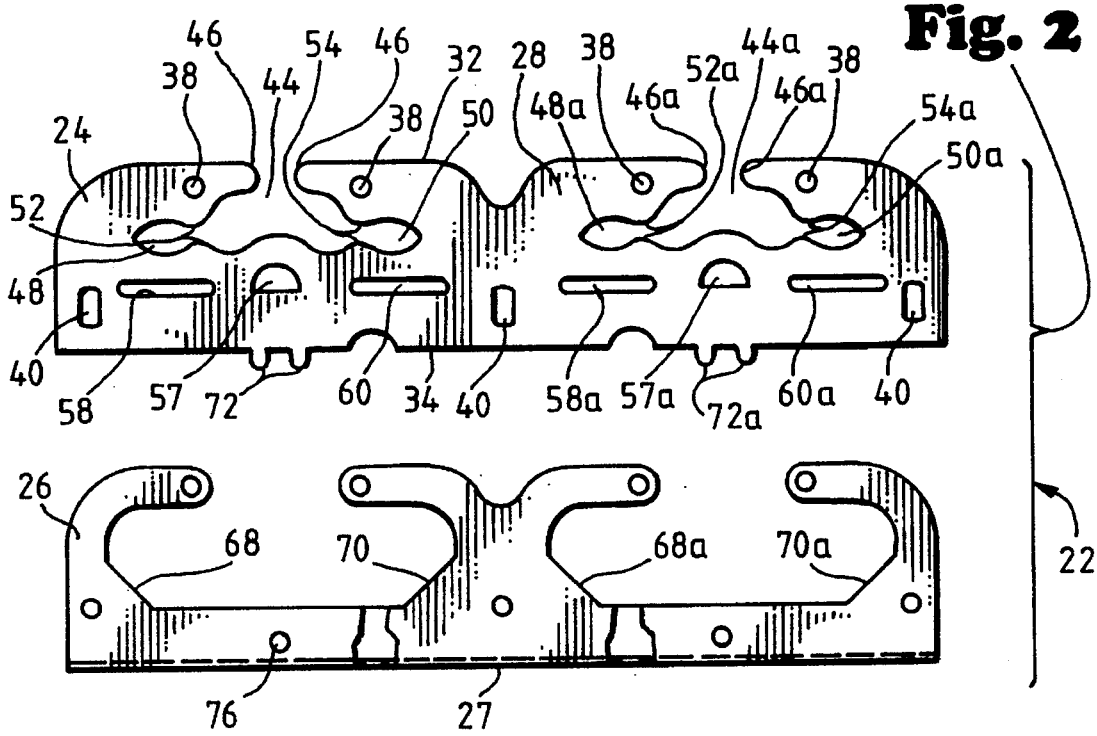
FIG. 2 is an exploded elevational view of the preferred embodiment of the arrow holder of the present invention.

Referring now to FIG. 1, the reference numeral 10 generally indicates a quiver 10 having a support 12 for attachment to other means such as a bow or body for supporting a plurality of arrows 14 having a shaft 16 with the usual fletches 18 and points (not shown) which are supported from a base such as styrofoam 20. The quiver 10 includes the arrow holder 22 of the present invention which is adapted to hold arrows 14 having different sized shafts 16.

Referring now to FIGS. 2–6, the preferred embodiment of the arrow holder 22 is a four arrow holder and generally includes a flexible mount 24, preferably rubber, and a rigid bracket 26, preferably metal, for engaging and supporting the flexible mount 24. While the quiver 10 in FIG. 1 is shown in the vertical position, the quiver 10 and, of course, the arrow holder 22 may be in any of various positions. For purposes of definition only, and without limiting its position, the flexible mount 24 includes a top 28, a bottom 30, a front 32 and a back 34.

The bracket 26 is preferably a U-shaped bracket (FIG. 6) which partially encloses and supports the top 28 and the bottom 30 of the flexible mount 34 by a plurality of mounting screws 36. The mounting screws 36 pass through openings 38 and 40 in the flexible mount 24. It is to be noted that the openings 40 are oval shaped extending towards the front 32 and back 34 of the mount 24 for allowing limited movement of the back 34 as will be more fully described hereinafter for adjusting the arrow space. Screws 42 (FIGS. 1 and 3) support the arrow holder 22 from the quiver support 12. The four arrow holder 22 includes a first entrance 44 and a second entrance **44*a* at the front 32 of the mount 24 with a flexible tip 46 and 46*a*, respectively, positioned on each size of the entrances 44 and 44*a*, respectively. The flex tips 46 and 46*a* provide an entrance or exit point for the shafts 16 of the arrows 14 and when arrows 16 are inserted or removed from the entrances 44 and 44*a*, there is a limited movement at the flex tips 46 and 46*a*. The flex tips 46 and 46*a* need to have only limited movement to provide an extra locking action for large and midsize arrows. The tips 46 and 46*a* are allowed some rotation around the top mounting screws 36**.

The mount 24 also includes first and second variable sized arrow shaft storage spaces 48 and 50 which are connected to the entrance 44 and storage spaces **48*a* and 50*a* which are connected to the entrance 44*a*. The storage spaces 48, 50, 48*a* and 50*a* are for receiving a shaft 16 and the spaces may be adjusted, as will be more fully described hereinafter, for securely holding different sized shafts. A pair of opposing shaft restrictors 52 and 54 are positioned between the storage areas 48 and 50 and the entrance 44. Similarly, a pair of opposing shaft restrictors 52*a* and 54*a* are positioned between each of the storage spaces 48*a* and 50*a*, respectively, and the entrance 44*a*. The arrow restrictors 52, 54, 52*a* and 54*a*** serve as an entrance and an exit to their respective storage spaces and serve to releasably lock a shaft in their adjacent storage spaces.

A diverter peak 56 is positioned in the entrance 44 and midway between the shaft storage spaces 48 and 50. Similarly, a diverter peak **56*a* is positioned in the entrance 44*a* and between the shaft storage spaces 48*a* and 50*a*. The diverter peaks 56 and 56*a* divert arrow shafts to the storage spaces and also prevent unnecessary noise by directing arrows from the arrow spaces 48, 50, 48*a* and 50*a* to the entrances 44 and 44*a*, respectively, instead of straight across when removing arrows. A compression slot 57 and 57*a* is positioned under each peak 56 and 56*a*, respectively. The slots 57 and 57*a* allow for extra backward movement of the peak 56 and 56*a* so the flex tips 46 and 46*a***, respectively, can release an arrow and move forward.

Figure 3:
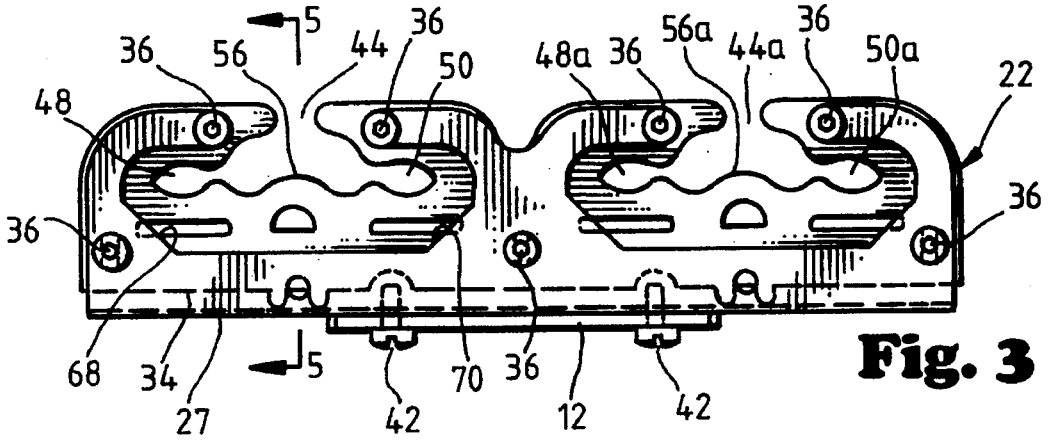
FIG. 3 is an elevational view of the assembled arrow holder of FIG.

A capacity insert slot 58 and 60 are positioned on the mount 24 adjacent the storage spaces 48 and 50, respectively. Similarly, capacity insert slots **58*a* and 60*a* are positioned adjacent the spaces 48*a* and 50*a*, respectively. One of the adjustments that can be made in the arrow holder 22 is by positioning an insert 62 (FIG. 6) into one of the slots 58, 60, 58*a* and 60*a*, which will compress and change the volume of the adjacent storage space thereby reducing the size range of arrows that will fit into the effected storage space. Thus, by inserting an insert 62 into one of the slots 58, 60, 58*a* or 60*a*, the volume of the adjacent storage space 48, 50, 48*a* or 50*a*, respectively, will be reduced. Preferably, the inserts 62 are curved thereby having a concave face 64 and a convex face 66. Therefore, the amount that a storage space can be reduced depends upon the positioning of the reversible inserts 62 into one of the slots. Of course, if desired, different sized inserts could be used for changing the adjustment. Preferably, the rigid bracket 26 includes shoulders 68 and 70 and 68*a* and 70*a* for covering portions of the slots 58, 60, 58*a* and 60*a*, respectively, as best seen in FIGS. 3 and 4 for retaining any insert 62** which may be positioned in those slots.

Another means is provided for adjusting the variable capacity of the storage spaces 48, 50, **48*a* and 50*a*. As illustrated in FIG. 3, the back 34 of the flexible mount 24 is preferably spaced from the back 27 of the rigid bracket 26. Contact points 72 are located adjacent the compression slot 57 and contact points 72*a* are located adjacent compression slot 57*a*. Contact points limit the movement of the arrow retractors in comparison to the movement allowed in the storage spaces. Thus they act to limit the backward movement of the back 34 towards the back 27 of the bracket so that in one mode of use the arrow restrictors 52, 54, 52*a* and 54*a* will be in a higher position when arrows are installed so as to let the arrow restrictors grip the arrow better. But in addition, the contact points 72 and 72*a* are positioned adjacent mount positioning means which includes in one embodiment a screw 74 (FIGS. 4 and 6) which is insertable into a hole 76 and compressing the back 34 of the flexible mount 24 towards the front 32 for again adjusting the size of the storage spaces 48, 50, 48*a* and 50*a*. As has previously been described, the flexible mount 24 includes oval holes 40 through which the lower screws 36 pass but which allows a controlled forward and backward movement of the back 34 of the mount 24. Thus, when the mount positioning means, such as the positioning screws 36 are omitted, this allows the back 34 to expand rearwardly and enlarge the storage spaces 48, 50, 48*a* and 50*a*. That is, with the positioning screws 36 omitted, the back 34 of the flexible rubber mount 24 may expand backwardly and is only restricted by the movement of the contact points 72 engaging the rear 27 of the bracket 26**.

Figure 4:
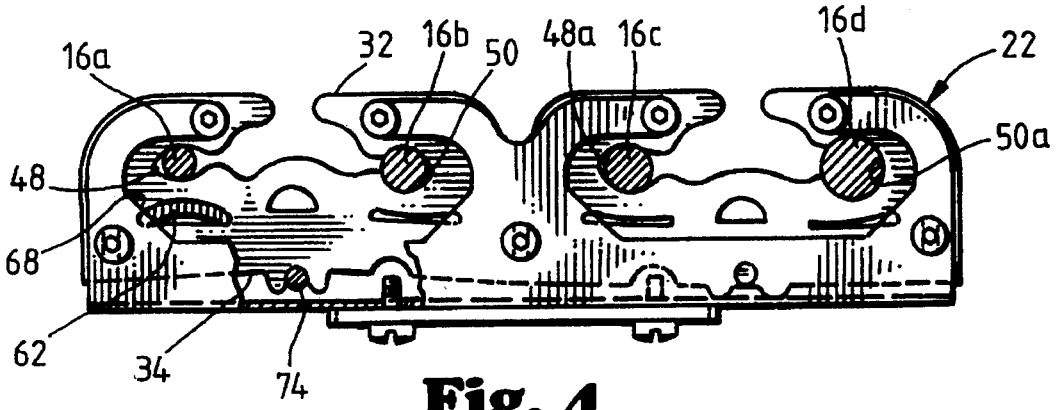
FIG. 4 is an elevational view of the arrow holder of FIG. 3 shown holding our arrows having different sized shafts.

However, with the positioning screw 74 is inserted, as shown in FIG. 4 the back 34 of the flexible rubber mount 24 is pushed towards the front and reduces the volume of the variable capacity spaces 48 and 50. This reduces the arrow size range that will fit in the affected spaces.

Referring now to FIG. 4, the arrow holder is shown in use in which a single positioning screw 74 is inserted for adjusting the size of spaces 48 and 50 and in addition an insert 62 is positioned in the slot 58 for further adjustment of the storage spaces. As thus adjusted, the arrow holder 22 will securely hold a 0.196 diameter arrow 16*a* in space 48, a .240 diameter arrow 16*b* in space 50, a 19/64 four inch arrow 16*c* in space 48*a*, and a 24/64 arrow 16*b* in space 58.

Figure 7:
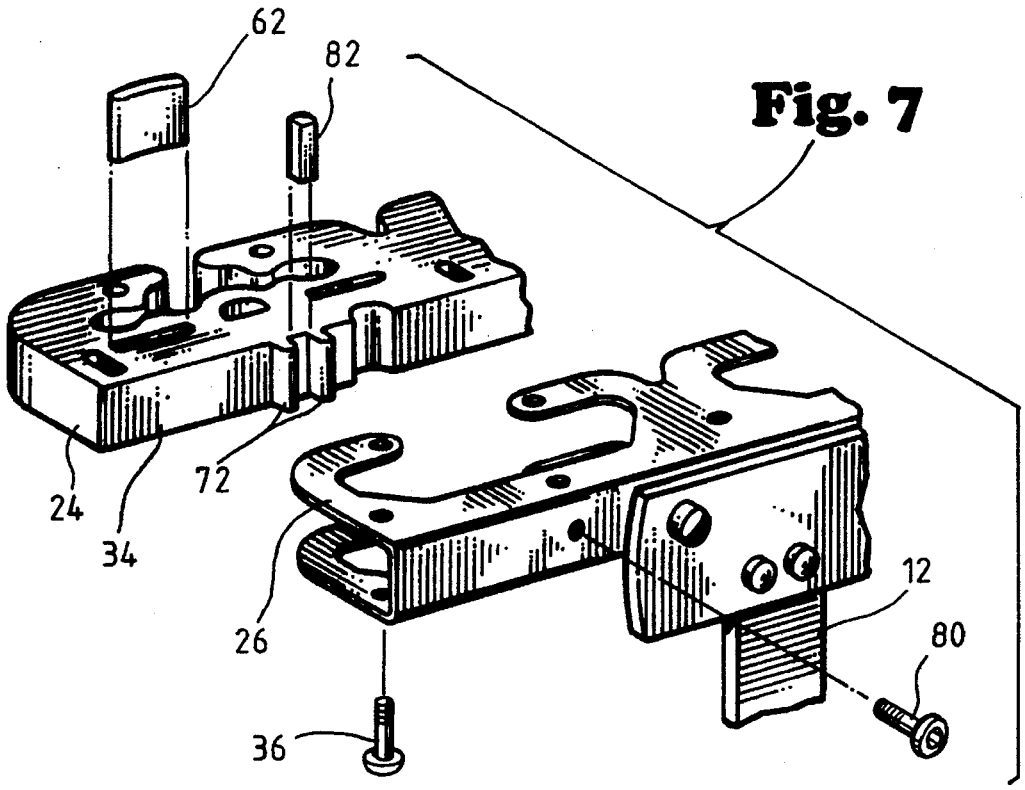
FIG. 7 is a fragmentary elevational exploded perspective view illustrating an alternate means for adjusting the arrow holder for different sized arrows.
Figure 8:
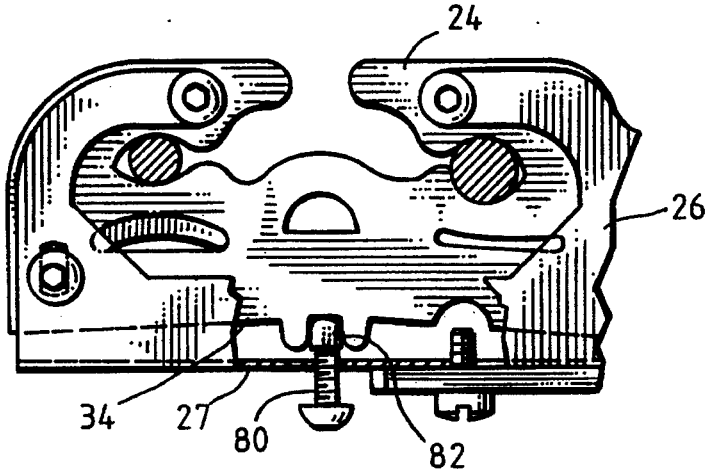
FIG. 8 is a fragmentary elevational view of the arrow holder of FIG. 7 in the assembled position.

As indicated in FIGS. 2–6, a mount positioning means, such as a positioning screws 74, may be provided for controlling the movement of the back 34 of the flexible mount 24 for adjusting the arrow capacity size of the arrow holder 22. Referring now to FIGS. 7 and 8, another embodiment of the mount positioning means is shown in which a positioning screw 80 acts against a block 82 to provide a variable adjustment of the position of the back 34 of the flexible mount 24 relative to the back 27 of the bracket 26. That is, the screw 80 is threaded through the back 27 and by threaded adjustment positions the block 82 and thus the back 34 at the desired adjustment for adjusting the arrow storage spaces.

Figure 10:
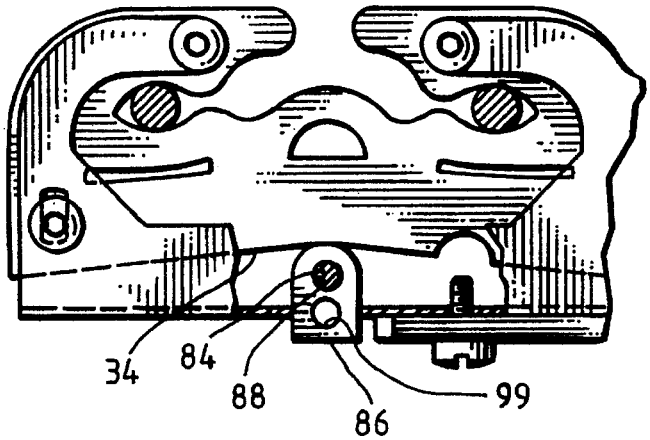
FIG. 10 is a fragmentary elevational view of the assembled arrow holder of FIG. 9.
Figure 9:
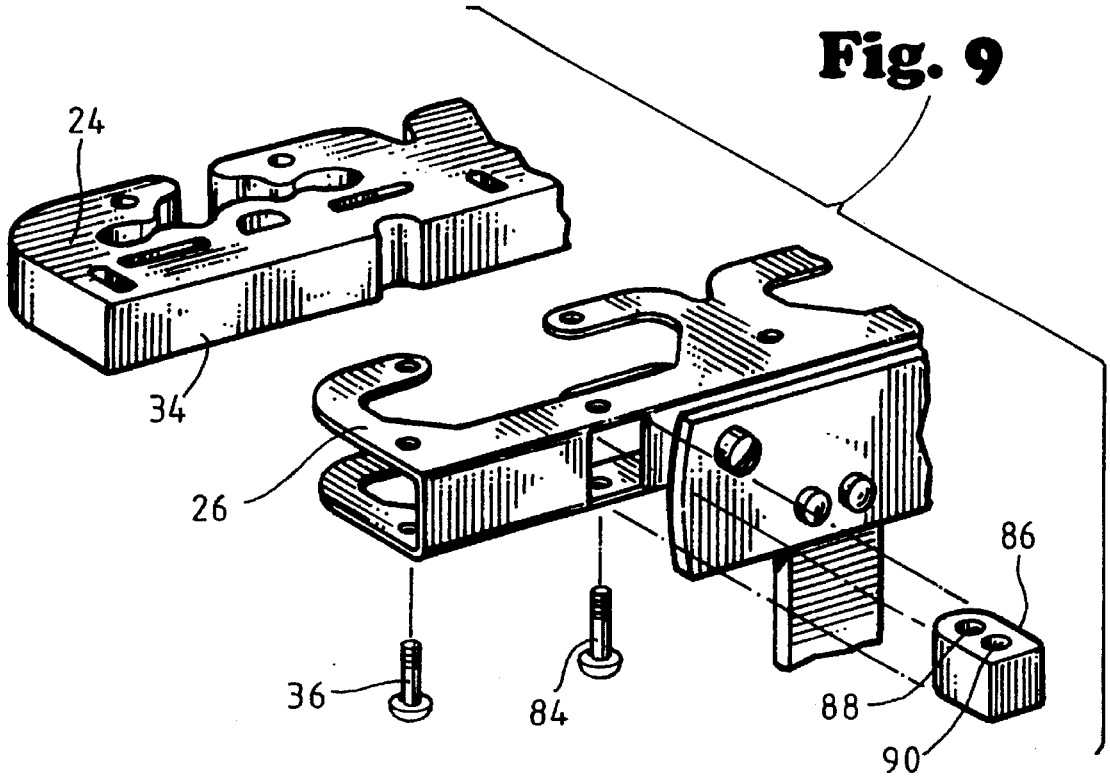
FIG. 9 is a fragmentary elevational exploded perspective view of another embodiment for adjusting the arrow holder of the present invention.

Referring to FIGS. 9 and 10, a still further embodiment of the mount positioning means is shown in which a positioning screw 84 is shown which coacts with a block 86 having a plurality of screw receiving holes 88. Thus, by screwing the positioning screw 84 into one of the holes, here hole 88, the compression force in the mount 24 may be suitably provided.

Figure 11:
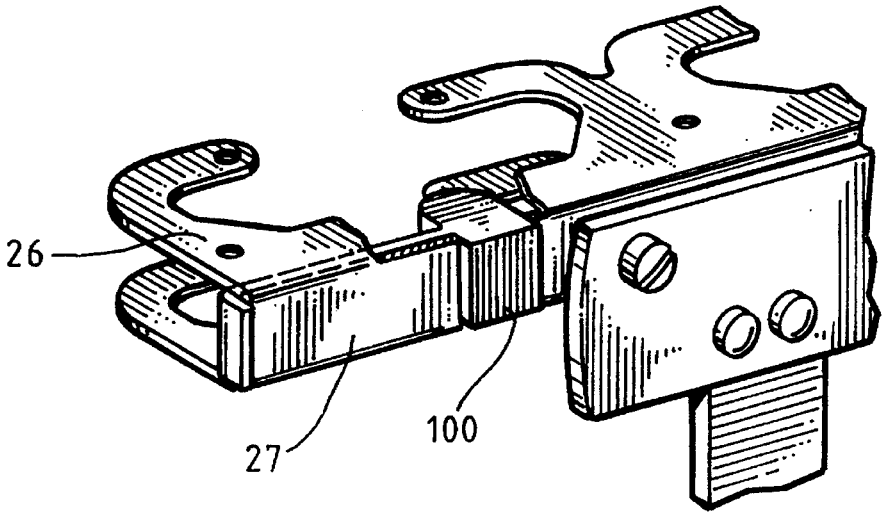
FIG. 11 is a fragmentary perspective view of still a further embodiment of means for adjusting the arrow holder of the present invention.

Still a further mount positioning means may be provided, such as in FIG. 11, in which a slip insert 100 may be provided for positioning inside the back 27 of the bracket 26 for engaging the back 34 of the mount 24 for adjusting the size of the arrow storage spaces.

Figure 12:
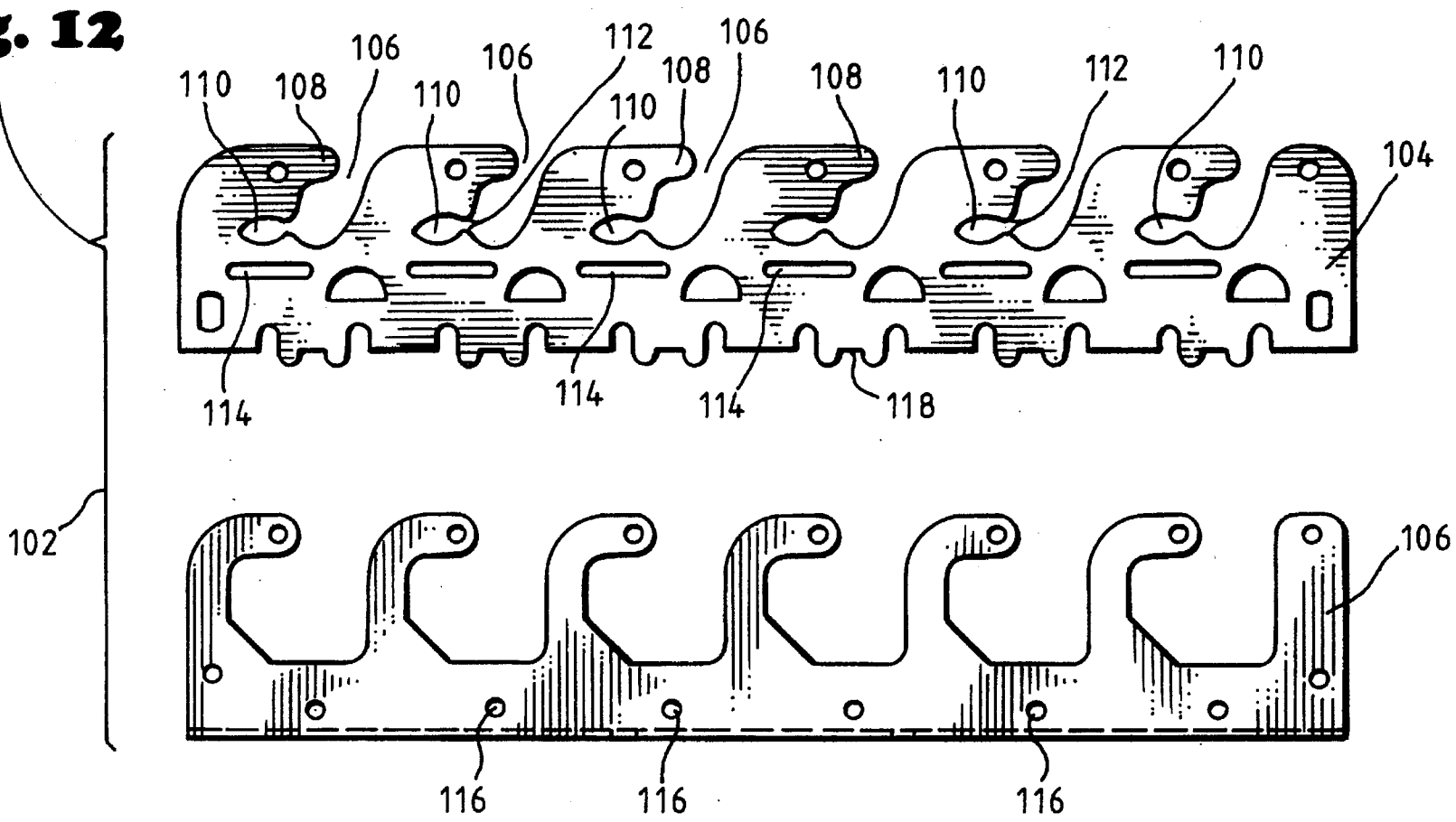
FIG. 12 is an exploded elevational view of a further embodiment of the present invention.

Referring now to FIG. 12, an arrow holder 102 is shown which is adapted to carry six arrows of various sizes. The holder 102 includes a flexible mount 104 and a rigid U-shaped metal bracket 106 which encloses and supports the mount 104 similar to the earlier embodiment. Similarly to the earlier embodiment, the mount 104 includes a plurality of entrances 106 with a flexible tip 108 positioned adjacent the side of each entrance 106. The mount 104 includes a plurality of arrow shaft storage spaces 110 each connected to one of the entrances 106 for receiving a shaft. A pair of opposing arrow shaft restrictors 112 are positioned between each of the storage spaces 110 and its connected entrance 106. A capacity insert slot 114 is positioned adjacent to each of the storage spaces 110 for receiving an insert for changing the size of the storage space. The bracket 106 includes a plurality of openings 116 for receiving a positioning screw (not shown) for compressing the back 118 of the mount 104.

Figure 13:
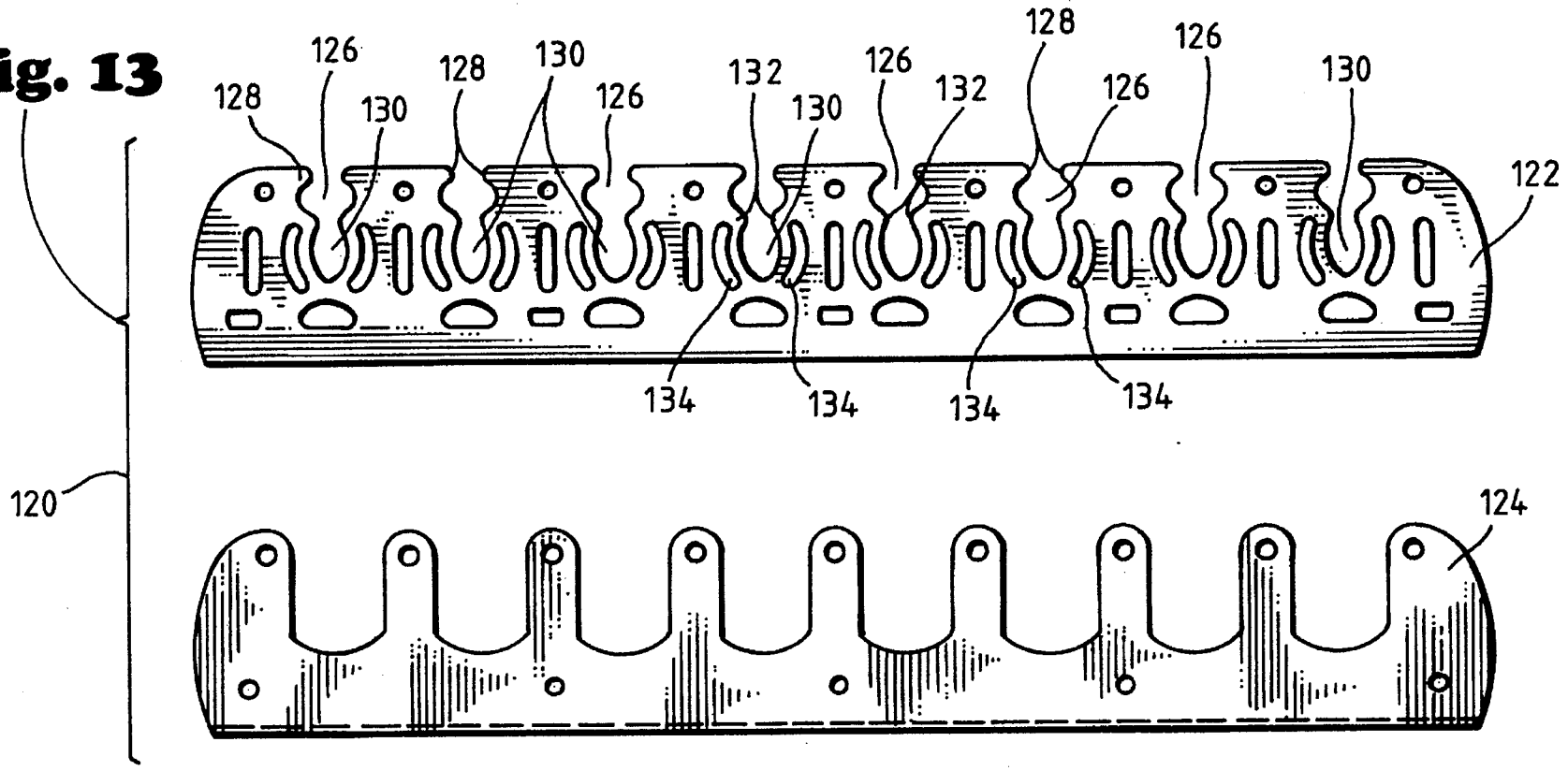
FIG. 13 is an exploded view of still a further embodiment of the present invention.

Referring now to FIG. 13, an alternative embodiment of the present invention is shown for accommodating eight arrows of varying sizes. The arrow holder of FIG. 13 indicated by the reference numeral 120 includes a flexible mount 122 and a metal U-shaped bracket 124 for receiving and supporting the mount 122. The mount 122 includes a plurality of entrances 126 with a flexible tip 128 positioned on each side of each entrance 126. An arrow shaft storage space 130 is provided connected to each entrance 126 for receiving an arrow shaft. A pair of opposing arrow shaft restrictors 132 are positioned between the storage space 130 and its connected entrance 126. Preferably, a capacity insert slot 134 is positioned in the mount 122 adjacent each side of storage area 130 for receiving an insert for changing the size of the storage space 130. A series of different size capacity inserts may be used for adjusting the storage spaces 130.

In use, in all of the embodiments, arrows 14 are inserted straight down through the limited flex lock tips to either the diverter peak or directly to one of the storage spaces. Enough downward arrow movement is required to let the limited flexible lock tips move back up and release. In the case of the embodiment of FIGS. 1–6, the arrow is then moved either to the right or left through the restrictor tips into a variable capacity arrow space. The arrow may be removed by reverse operation.

In the embodiment of FIGS. 1–6, there are six possible settings for sizing the storage spaces in the arrow holder 22. The first three positions utilize no positioning screw 74 while the second three positions use the positioning screw 74. The settings and ranges of arrow diameter accommodated are as follows:

| | |
|---|---|
| 1 = No Inserts | 25/64" to 21/64" |
| 2 = Insert with convex up | 19/64" to 17/64" |
| 3 = Insert with concave up | 20/64" to 17/64" |
| 4 = No Inserts | 20/64" to .210 |
| 5 = Insert with convex up | .210 to .180 |
| 6 = Insert with concave up | .220 to .196 |

The present invention, therefore, is well adapted to carry out the objects and attain the ends and advantages mentioned as well as others inherent therein.

While presently preferred embodiments of the invention have been given for the purpose of disclosure, numerous changes in the details of construction, and arrangement of parts may be made which will readily suggest themselves to those skilled in the art, and which are encompassed within the spirit of the invention and the scope of the appended claims.

What is claimed is:

1. In an arrow holder for holding arrows having different sized shafts, the improvement comprising, a flexible mount for receiving different sized shafts of arrows, said mount having a top, bottom, front and back, a rigid bracket engaging and supporting the top and bottom of the flexible mount, said mount having an entrance at the front with a flexible tip positioned on each side of the entrance, said mount having at least one arrow shaft storage space connected to the entrance for receiving a shaft, a pair of opposing arrow shaft restrictors positioned between the storage space and the entrance, and a capacity insert slot positioned in the mount adjacent the storage space for receiving an insert for changing the size of the slot thereby adjusting the size of the storage space.

2. The arrow holder of claim i including, an insert for insertion into the capacity insert slot, said insert being curved for providing a different sized storage space.

3. The arrow holder of claim 1 including, mount positioning means connected between the bracket and the back of the flexible mount for changing the position of the back relative to the front and changing the capacity of the storage space.

4. The arrow holder of claim 3 wherein the mount positioning means is a screw.

5. The arrow holder of claim 3 wherein the mount positioning means is a multi-position insert.

6. The arrow holder of claim 3 wherein the mount positioning means is a slip insert positioned between the back of the mount and the bracket.

7. The arrow holder of claim 3 including, a pair of contact points on the back of the flexible mount positioned for engagement by the mount positioning means.

8. The arrow holder of claim 1 wherein the flexible mount includes oval holes extending between the front and back for receiving fasteners for allowing front to back movement of the mount relative to the bracket.

9. In an arrow holder for holding arrows having different sized shafts, the improvement comprising, a flexible mount for receiving different sized shafts of arrows, said mount having a top, bottom, front and back, a rigid U-shaped bracket engaging and supporting the top and bottom of the flexible mount, said mount having an entrance at the front of the mount with a flexible tip positioned on each side of the entrance, said mount having first and second variable sized arrow shaft storage spaces each of which spaces are connected to the entrance for receiving a shaft, a pair of opposing shaft restrictors positioned between each storage space and the entrance, and a capacity insert slot positioned in the mount adjacent each storage space for receiving an insert for changing the size of the slot thereby adjusting the size of the adjacent storage space.

10. The arrow holder of claim 9 including, a diverter peak positioned in the entrance midway between the first and second shaft storage spaces.

11. The arrow holder of claim 10 including, a compression slot positioned adjacent the diverter peak.

* * * * *

UNITED STATES PATENT AND TRADEMARK OFFICE

CERTIFICATE OF CORRECTION

PATENT NO. : 5,452,703

DATED : Sept. 26, 1995

INVENTOR(S) : Bateman, III

It is certified that error appears in the above-indentified patent and that said Letters Patent is hereby corrected as shown below:

Column 2, line 40, after "FIG." insert -- 2 --

Column 2, line 42, delete "our" and insert -- four --

Column 3, line 8, delete "fietches" and insert -- fletches --

Column 6, line 52, delete "i" and insert -- 1 --

Signed and Sealed this

Thirty-first Day of December, 1996

*Attest:*

Bruce Lehman

BRUCE LEHMAN

*Attesting Officer*

*Commissioner of Patents and Trademarks*